US011456104B2

(12) United States Patent
Dormia et al.

(10) Patent No.: US 11,456,104 B2
(45) Date of Patent: Sep. 27, 2022

(54) TRANSFORMER ASSEMBLY WITH SHRINKAGE COMPENSATION

(71) Applicant: Hitachi Energy Switzerland AG, Baden (CH)

(72) Inventors: Georges Dormia, Douvaine (FR); Lakhdar Gaoua, Le Pont de Claix (FR); Lorenzo Dus, Meyrin (CH); Toufann Chaudhuri, Morges (CH); Yann Cuenin, Saint-Martin (CH)

(73) Assignee: Hitachi Energy Switzerland AG, Baden (CH)

( * ) Notice: Subject to any disclaimer, the term of this patent is extended or adjusted under 35 U.S.C. 154(b) by 864 days.

(21) Appl. No.: 16/297,854

(22) Filed: Mar. 11, 2019

(65) Prior Publication Data

US 2019/0206607 A1 Jul. 4, 2019

Related U.S. Application Data

(63) Continuation of application No. PCT/EP2017/072507, filed on Sep. 7, 2017.

(30) Foreign Application Priority Data

Sep. 9, 2016 (EP) ..... 16188074

(51) Int. Cl.
*H01F 27/24* (2006.01)
*H01F 27/30* (2006.01)
(Continued)

(52) U.S. Cl.
CPC ..... *H01F 27/24* (2013.01); *H01F 27/28* (2013.01); *H01F 27/303* (2013.01); *H01F 41/0206* (2013.01); *H01F 41/04* (2013.01)

(58) Field of Classification Search
CPC ..... H01F 27/24; H01F 27/28; H01F 27/303; H01F 41/0206; H01F 41/04
See application file for complete search history.

(56) References Cited

U.S. PATENT DOCUMENTS 3,772,627 A * 11/1973 Wilk ..... H01F 27/303 336/197
4,255,868 A 3/1981 Holzwarth
(Continued)

FOREIGN PATENT DOCUMENTS

CN 202384172 U 8/2012
CN 103733281 A 4/2014
(Continued)

OTHER PUBLICATIONS

Office Action dated Oct. 26, 2020, Chinese Patent Application No. 201780069338.4, 6 pages.
(Continued)

*Primary Examiner* — Don P Le
(74) *Attorney, Agent, or Firm* — Sage Patent Group

(57) ABSTRACT

A transformer assembly with shrinkage compensation during drying or curing of the windings including: a core having two yokes and two legs, a winding provided about at least one of the two legs of the core, the winding being insulated by an insulating material, a metal profile per yoke, extending in parallel to the respective yoke and being mounted to it, and two pistons seated in the metal profiles, the pistons being movable along their axial direction which is parallel to the longitudinal axis of the at least one winding, wherein the at least two pistons exert a force on the at least one winding in an axial direction of the windings.

20 Claims, 3 Drawing Sheets

(51) Int. Cl.

| | |
|---|---|
| ***H01F 27/28*** | (2006.01) |
| ***H01F 41/02*** | (2006.01) |
| ***H01F 41/04*** | (2006.01) |

(56) References Cited

U.S. PATENT DOCUMENTS

| | | | | |
|---|---|---|---|---|
| 7,830,233 | B2 * | 11/2010 | Hrkac | H01F 41/063 336/170 |
| 2007/0132537 | A1 | 6/2007 | Osbun et al. | |
| 2019/0066902 | A1 * | 2/2019 | Taméz Torres | H01F 27/306 |

FOREIGN PATENT DOCUMENTS

| | | | |
|---|---|---|---|
| CN | 203966732 | U | 11/2014 |
| CN | 204028192 | U | 12/2014 |
| CN | 204792382 | U | 11/2015 |
| CN | 205012978 | U | 2/2016 |
| DE | 2820740 | A1 | 11/1979 |
| EP | 2530686 | A1 | 12/2012 |
| FR | 2820541 | A1 | 8/2002 |

OTHER PUBLICATIONS

Notification to Grant dated Feb. 1, 2021, Chinese Patent Application No. 201780069338.4, 4 pages.

European Patent Office, International Search Report & Written Opinion issued in corresponding Application No. PCT/EP2017/072507, dated Oct. 26, 2017, 14 pp.

* cited by examiner

TRANSFORMER ASSEMBLY WITH SHRINKAGE COMPENSATION

TECHNICAL FIELD

The present invention relates to transformer assemblies, in particular transformer assemblies for power applications, and for improved methods for producing such transformer assemblies.

BACKGROUND OF THE INVENTION

During the manufacturing of transformers, such as for traction, power or distribution purposes, windings are typically exposed to a drying process, mainly to eliminate traces of water from the insulating material. During this process, the insulating material shrinks, thereby leading to a small decrease, inter glia, in the axial length of windings.

The active part of a traction transformer comprises one or more windings and a core assembly. During manufacturing, this active part is usually clamped with a mechanical, insulating structure composed by pressure plates and beams. These parts may, for example, be made in wood or in polyester based materials reinforced with fibre glass. A number of metallic axial tie rods are typically installed between the beams, the tie rods allowing to maintain a certain pre-stress force on the windings.

The pre-stress force is applied via the tie rods to the pressure plates and beams. Thereby, during the drying process to which the winding is exposed during the manufacturing process, the winding shrinks along its axial dimension. Hence, in order to desirably maintain the pre-stress force on the windings during the manufacturing process, conventionally the tie rods have to be re-tightened occasionally. This has typically to be repeated a number of times after a certain amount of time, so that the exerted force on the windings is essentially maintained through the entire drying process.

Furthermore, in order to deliver sufficient stability, the assembly of the pressure plates, beams and tie rods must sufficiently be dimensioned, thus resulting in a mass which contributes considerably to the weight of the transformer assembly.

In view of the above and for other reasons, there is a need for the present invention.

SUMMARY OF THE INVENTION

According to a first aspect, a transformer assembly with shrinkage compensation during drying or curing of the windings is provided. The assembly comprises: a core having at least two yokes and at least two legs; at least one winding provided about at least one of the at least two legs of the core, the at least one winding being insulated by an insulating material; at least one metal profile per yoke, extending in parallel to the respective yoke and being mounted to it; and at least two pistons seated in at least one of the metal profiles, the pistons being movable along their axial direction which is parallel to the longitudinal axis of the at least one winding, wherein the at least two pistons exert a force on the at least one winding in an axial direction of the windings.

In a second aspect, a method of compensating the shrinkage during drying or curing of windings in a transformer assembly is provided. The method comprises assembling a transformer assembly according to the first aspect, and, during a drying process or a curing process, applying a force on the winding through pistons.

Further aspects, advantages and features of the present invention are apparent from the dependent claims, their combinations, the description and the accompanying drawings.

BRIEF DESCRIPTION OF THE DRAWINGS

A full and enabling disclosure, including the best mode thereof, to one of ordinary skill in the art is set forth more particularly in the remainder of the specification, including reference to the accompanying figures wherein.

DETAILED DESCRIPTION OF THE INVENTION

Figure 1:
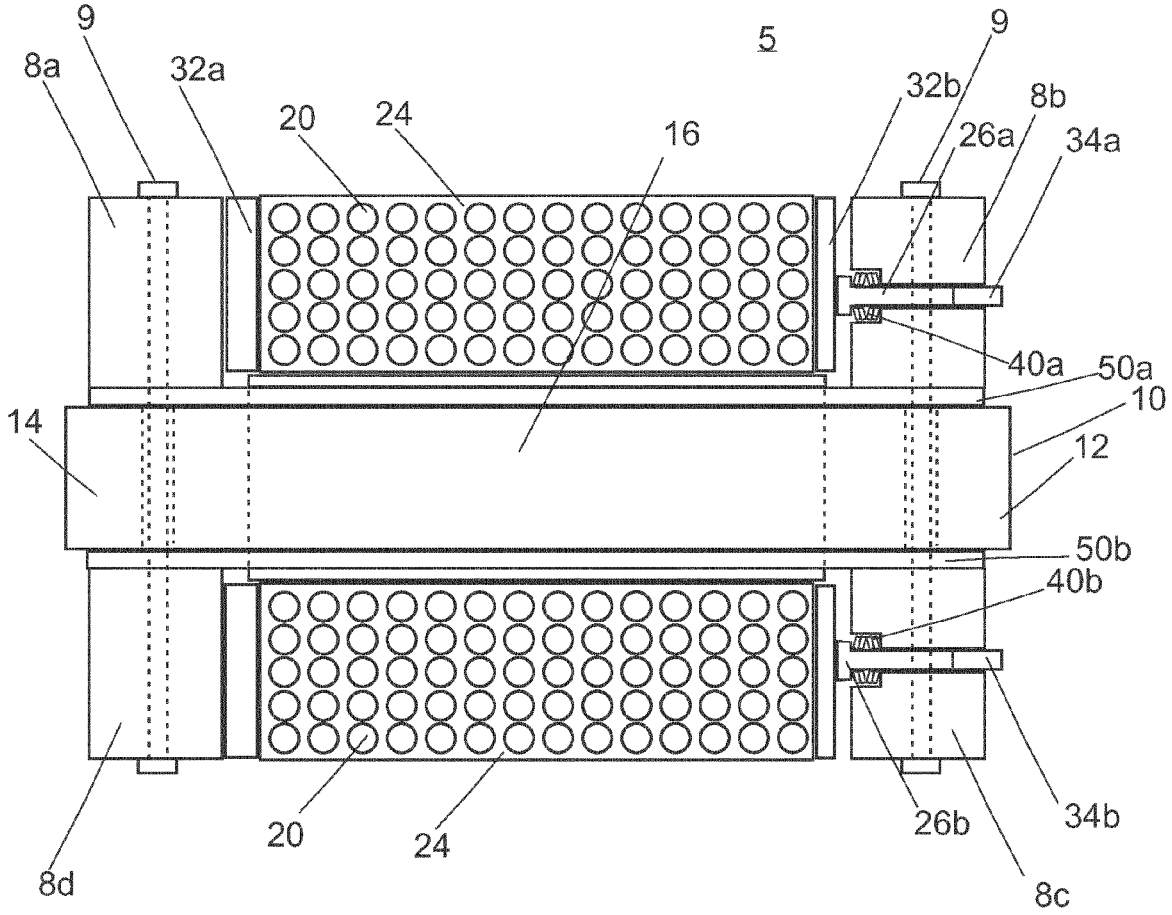
FIG. 1 schematically shows a cross-sectional view of a transformer assembly according to embodiments.

Reference will now be made in detail to various embodiments, one or more examples of which are illustrated in each figure. Each example is provided by way of explanation and is not meant as a limitation. For example, features illustrated or described as part of one embodiment can be used on or in conjunction with other embodiments to yield yet further embodiments. It is intended that the present disclosure includes such modifications and variations.

Within the following description of the drawings, the same reference numbers refer to the same components. Generally, only the differences with respect to the individual embodiments are described. When several identical items or parts appear in a figure, not all of the parts have reference numerals in order to simplify the appearance.

The systems and methods described herein are not limited to the specific embodiments described, but rather, components of the systems and/or steps of the methods may be utilized independently and separately from other components and/or steps described herein. Rather, the exemplary embodiment can be implemented and used in connection with many other applications.

Although specific features of various embodiments of the invention may be shown in some drawings and not in others, this is for convenience only. In accordance with the principles of the invention, any feature of a drawing may be referenced and/or claimed in combination with any feature of any other drawing.

Generally, embodiments described herein pertain to a transformer assembly, which may be a traction transformer for rail vehicles, or generally a transformer for power conversion applications and for power distribution. The assembly comprises a system able to compensate the shrinkage of the winding insulation when drying. This system comprises a mobile piston, pushing the windings, and by a pre-stress screw, henceforth also called adjustment screw, imposing a force on the windings. A bell is typically also employed to transmit the force from the piston to the metal profiles. Spring elements, typically in the form of a stack of spring washers, compensate for the variations of the winding dimensions due to the drying and thermal cycles. Thereby, a decrease of the average manufacturing time of a transformer is achieved, in particular a decrease if the assembly time needed for the active part mounting and to the drying process. Generally, after the drying or curing process of the winding is completed, the transformer assembly is typically further used in a productive environment, e.g., in a railway train. The above-described system used for the shrinkage compensation is then employed to exert a force on the winding(s) in order to maintain their stability, which is particularly useful in the environment of a railway train or locomotive.

Thereby, the spring elements are generally typically configured such that, after the drying or curing is completed, a force exerted on the at least one winding during the further operation of the transformer is dimensioned to be higher than a potentially expanding electromagnetic force of the winding in case of a short circuit condition of the transformer. This ensures that the integrity of the winding is maintained against vibration and shock during normal operation, and is also maintained in case of short circuit. Thereby, the pistons typically move for a distance from about 0.5 mm to about 4 mm, more typically from about 1 mm to about 3 mm during drying or curing. During subsequent transformer operation in the field, the pistons typically move only for a negligible distance in case of a short circuit, as the force exerted by the pistons is configured to be higher than the expanding electromagnetic force of the winding. The pistons typically move in a direction towards the metal profiles only during differential thermal expansion of the winding versus the core during operation (e.g. after cold start-up), which occurs within a time constant of some minutes, e.g. 2 minutes to 10 minutes. Thus, a movement of the pistons towards the metal profiles, away from the center of the winding, may occur due to thermal expansion during normal operation, but not due to the electromagnetic forces during a short circuit condition. Thus, during a short circuit condition, the counteracting force exerted by the spring elements on the pistons hinders the pistons from being moved by the electromagnetic forces caused by the short circuit condition. If the short circuit condition would persist for a longer time span of e.g. 15 seconds or more, the resulting heating and thermal expansion of the copper might, however, lead to thermal expansion of the winding, which may subsequently lead to a movement of the pistons towards the metal profiles. In practice, however, a short circuit condition is typically terminated latest after a few seconds by a protection mechanism, which is part of the railway train or locomotive.

Furthermore, in embodiments, the active part of the transformer is generally clamped with metal profiles, which preferably are aluminium extruded profiles. This allows for weight reduction and material cost savings.

In embodiments, reinforcements are installed along the legs of the transformer and are located between the magnetic core and the windings. The reinforcements are in the following also called mechanical connection elements. These reinforcements or mechanical connection elements rigidify the magnetic core and counteract short circuit forces from the windings. The force is transmitted from the windings to the metal profile via the pistons and then, the stress loop is closed through the reinforcements along the leg. A counter-shape on the base of the metal profile(s) is intended for the installation of these reinforcements.

In FIG. 1, a cross-sectional view on a transformer assembly 5 according to embodiments is shown. The core 10 has two yokes 12, 14 and two legs 16, 18 (herein, only leg 16 is visible due to the perspective). Two windings 20, 22 are provided about the legs 16, 18, whereby only winding 20 is visible in FIG. 1. The windings 20, 22 are insulated by an insulating material 24, which is only schematically shown in FIG. 1. The insulating material 24 may for example be an aramid paper or the like.

Above and below each of the yokes 12, 14, metal profiles 8*a*, 8*b*, 8*c*, 8*d* are mounted. The metal profiles 8*a*, 8*b*, 8*c*, 8*d* extend in parallel to the respective yoke 12, 14 and are mounted to the yokes 12, 14 via bolts 9. In FIG. 1, the metal profiles 8*a*, 8*b*, 8*c*, 8*d* extend perpendicular to the drawing plane and are thus only visible as a cross-section.

Pistons 26*a*, 26*b* are seated in the metal profiles 8*a*, 8*b*, 8*c*, 8*d*, wherein the pistons 26*a*, 26*b* are movable along their axial direction. Their axial direction is parallel to the longitudinal axis of the winding(s) 20, 22. The pistons 26*a*, 26*b* thereby exert a force on the winding 20, 22 in an axial direction of the winding 20, 22. When the winding 20, 22 shrinks in its length dimension (left-right in FIG. 1) due to a drying process, the pistons 26*a*, 26*b* compensate for this length difference. To this end, the pistons 26*a*, 26*b* are mounted with spring elements 40*a*, 40*b*. These spring elements 40*a*, 40*b* are typically embodied by a stack of spring washers, such as in the embodiment shown in FIG. 1. The spring elements 40*a*, 40*b* may also be embodied by using other means, such as spiral springs, or the like.

Figure 2:
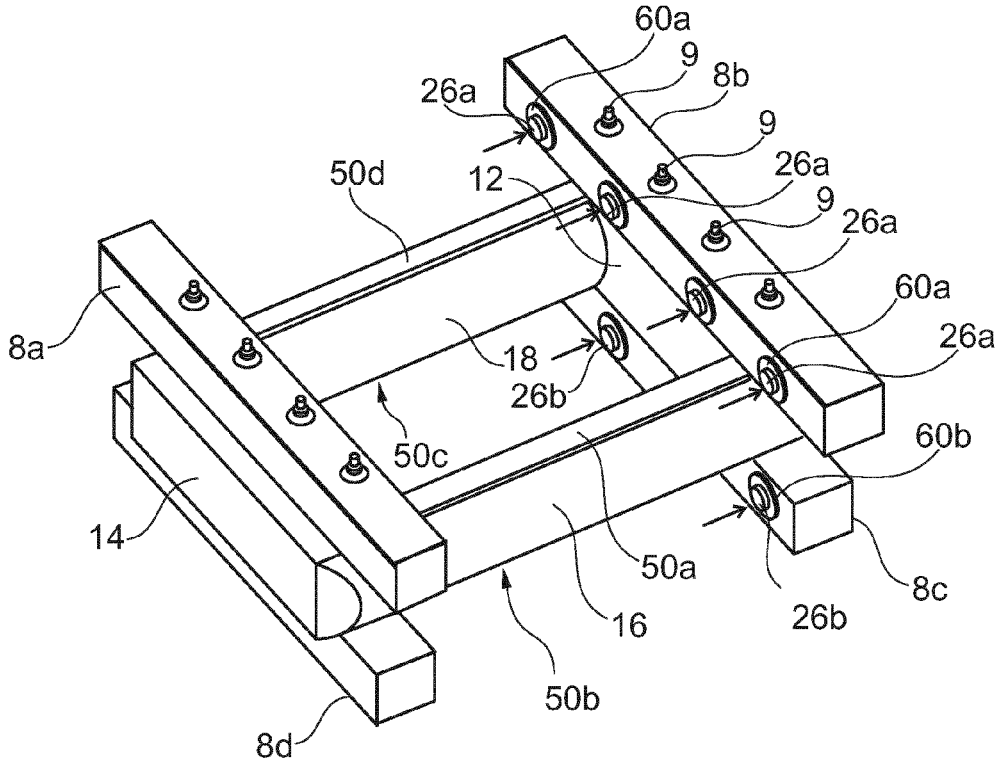
FIG. 2 schematically shows a perspective schematic view on a part of the transformer assembly of FIG. 1.

Mechanical connection elements 50*a*, 50*b*, 50*c*, 50*d* preferably extend in parallel to the windings 20, 22 (and to the legs 16, 18) between the metal profiles 8*a*, 8*b*, 8*c*, 8*d* which are provided on both ends of the windings 20, 22. The mechanical connection elements 50*a*, 50*b*, 50*c*, 50*d* comprise two elongated metal bars per leg, extending in parallel to each other and in parallel to the legs 16, 18 in a space between the legs 16, 18 and the respective windings 20, 22. Thereby, the elongated metal bars are mounted at their respective ends to at least one of the metal profiles 8*a*, 8*b*, 8*c*, 8*d*. In FIG. 2, a part of the transformer assembly is shown, wherein only the windings 20, 22 are left out for illustrational purposes.

Figure 3:
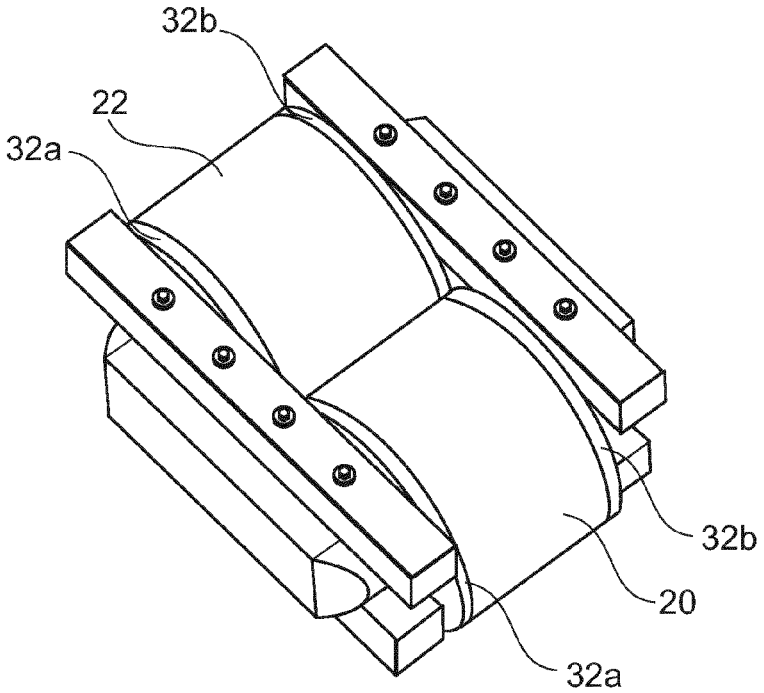
FIG. 3 schematically shows a perspective view on a transformer assembly as presented in FIG. 1.

Thus, FIG. 2 shows a perspective view on the assembly of FIG. 1 without windings. The arrows symbolize the force which the (left out) windings would exert on the metal profiles 8*a*, 8*b*, 8*c*, 8*d* via the pistons 26*a*, 26*b*. In FIG. 3, the same transformer assembly 5 is shown in complete form, that is, including windings 20, 22, and plates 32*b* and 32*a*.

Figure 4:
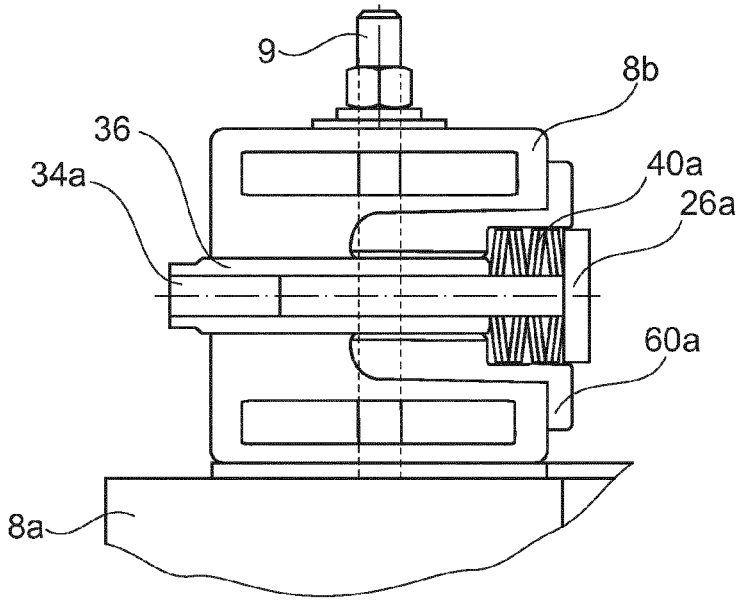
FIG. 4 schematically shows a cross-sectional view through a metal profile of a transformer assembly according to embodiments.

In embodiments, the metal profiles 8*a*, 8*b*, 8*c*, 8*d* comprise or consist of aluminium or an aluminium alloy. Thereby, two profiles 8*a*, 8*b*; 8*c*, 8*d* extend in parallel to each other on opposite sides of each of the yokes 12, 14. The pistons 26*a*, 26*b* are each seated in the metal profiles 8*a*, 8*b*, 8*c*, 8*d* via a bell 60*a*, 60*b* (not shown in FIG. 1). The bell 60*a*, 60*b* also preferably comprises or consists of aluminium. The bell 60*a*, 60*b* is intended to transmit the force from the piston 26*a*, 26*b* into the metal profile 8*a*, 8*b*, 8*c*, 8*d*. The bell 60*a*, 60*b* is particularly useful in the case of extruded metal profiles 8*a*, 8*b*, 8*c*, 8*d*, as schematically shown in FIG. 4. For each piston 26*a*, 26*b*, an adjustment screw 34*a*, 34*b* is used for adjusting a force of the piston 26*a*, 26*b* onto the respective winding 20, 22. The adjustment screw 34*a*, 34*b* is seated in an insert 36 having an inner thread. The insert 36 is fastened to the bell 60*a*, preferably also via a thread. A plate 32*b* is typically located between the pistons 26*a*, 26*b* and the windings 20, 22, in order to transmit the force from the pistons 26*a*, 26*b* to the windings 20, 22. In embodiments, the plate 32*b* comprises or consists of a polymer or a fiber-enforced resin. The plate 32*b* may be ring-shaped, such that it substantially covers the cross section of the winding 20, 22. The plate 32*b* may also comprise further functionality, for example oil conducts when the plate 32*b* is used for transporting/circulating insulating oil into the transformer 5. The plate 32*b* shall be able to withstand the punctual force from the pistons 26*a*, 26*b* on one side.

As can be seen in FIG. 2, on the other side of the windings 20, 22, there are no pistons, but a further plate 32*a*, which transmits the force from the windings 20, 22 (being pushed by the pistons 26*a*, 26*b* from the other side) onto the metal profiles 8*a*, 8*d*. As is shown in FIG. 2, a total number of four pistons 26*a*, 26*a*, 26*b*, 26*b* act on each winding 20, 22. Thereby, two pistons per winding are located in metal profile 8*b* and two pistons per winding are located in metal profile 8*c*, all on one end of the windings 20, 22. In other embodiments, the number of pistons per winding may differ. It goes without saying that the skilled person may, based on this disclosure, find other variants to provide the pistons 26*a*, 26*b* in the metal profiles 8*a*, 8*b*, 8*c*, 8*d*, which are regarded to fall under the present disclosure.

To sum up, the method of compensating the shrinkage during drying or curing of windings of a transformer assembly comprises: assembling a transformer assembly 5 as described above, and then, during a drying process or a curing process of the windings, applying a force on the winding through pistons. The force is obtained by spring elements, and a shrinkage of the windings during drying or curing is compensated by the pistons.

The transformer assembly may be one of a traction transformer for rolling stock, a distribution transformer, or a power transformer. It is preferably immersed in an insulating fluid, such as mineral oil or oil from organic sources.

This written description uses examples to disclose the invention, including the best mode, and also to enable any person skilled in the art to practice the invention, including making and using any devices or systems and performing any incorporated methods. While various specific embodiments have been disclosed in the foregoing, those skilled in the art will recognize that the spirit and scope of the claims allows for equally effective modifications. Especially, mutually non-exclusive features of the embodiments described above may be combined with each other. The patentable scope of the invention is defined by the claims, and may include other examples that occur to those skilled in the art. Such other examples are intended to be within the scope of the claims, if they have structural elements that do not differ from the literal language of the claims, or if they include equivalent structural elements with insubstantial differences from the literal language of the claims.

The invention claimed is:

1. A transformer assembly with shrinkage compensation during drying or curing of the windings, comprising:

a core having at least two yokes and at least two legs, at least one winding provided about at least one of the legs of the core, the at least one winding being insulated by an insulating material, at least one metal profile per yoke, extending in parallel to the respective yoke and being mounted to it, at least two pistons seated in at least one of the metal profiles, the pistons being movable along their axial direction which is parallel to the longitudinal axis of the at least one winding, wherein the at least two pistons exert a force on the at least one winding in an axial direction of the windings.

2. The transformer assembly according to claim 1, wherein the pistons are mounted with spring elements, and wherein the spring elements are configured such that, after the drying or curing is completed, a force exerted on the at least one winding is dimensioned to be higher than an expanding electromagnetic force of the winding in case of a short circuit condition of the transformer.

3. The transformer assembly according to claim 1, wherein the spring elements are at least one of: spring washers, and spiral springs.

4. The transformer assembly according to claim 1, further comprising mechanical connection elements extending in parallel to the windings between the metal profiles on both ends of the windings.

5. The transformer assembly according to claim 4, wherein the mechanical connection elements comprise elongated metal bars extending in parallel to each other and in parallel to the legs in a space between the legs and the respective windings, the elongated metal bars being mounted at their respective ends to at least one of the metal profiles.

6. The transformer assembly according to claim 1, wherein the at least one metal profile per yoke comprises aluminium.

7. The transformer assembly according to claim 1, having two metal profiles per yoke extending in parallel on opposite sides of each yoke.

8. The transformer assembly according to claim 1, wherein the pistons are each seated in the metal profiles via a bell, the bell consisting of aluminium.

9. The transformer assembly according to claim 1, wherein an adjustment screw is provided for each of the at least two pistons, and wherein the adjustment screw is used for adjusting a force of the piston.

10. The transformer assembly according to claim 1, wherein a plate is located between the at least two pistons and each winding to transmit the force from the at least two pistons to the windings.

11. The transformer assembly according to claim 10, wherein the plate comprises a polymer, preferably a fiber-enforced resin.

12. The transformer assembly according to claim 1, wherein the transformer is at least one of: a traction transformer for rolling stock, a distribution transformer, and a power transformer, and is preferably immersed in an insulating fluid.

13. The transformer assembly according to claim 2, wherein the spring elements are at least one of: spring washers, and spiral springs.

14. The transformer assembly according to claim 2, further comprising mechanical connection elements extending in parallel to the windings between the metal profiles on both ends of the windings.

15. The transformer assembly according to claim 2, further comprising mechanical connection elements extending in parallel to the windings between the metal profiles on both ends of the windings.

16. The transformer assembly according to claim 3, further comprising mechanical connection elements extending in parallel to the windings between the metal profiles on both ends of the windings.

17. The transformer assembly according to claim 15, wherein the mechanical connection elements comprise elongated metal bars extending in parallel to each other and in parallel to the legs in a space between the legs and the respective windings, the elongated metal bars being mounted at their respective ends to at least one of the metal profiles.

18. A method of compensating the shrinkage during drying or curing of windings in a transformer assembly, comprising:

assembling a transformer assembly comprising, a core having at least two yokes and at least two legs, at least one winding provided about at least one of the legs of the core, the at least one winding being insulated by an insulating material, at least one metal profile per yoke, extending in parallel to the respective yoke and being mounted to it, at least two pistons seated in at least one of the metal profiles, the pistons being movable along their axial direction which is parallel to the longitudinal axis of the at least one winding, wherein the at least two pistons exert a force on the at least one winding in an axial direction of the windings; and during a drying process or a curing process, applying a force on the winding through the pistons.

19. The method of claim 18, wherein the force is obtained by spring elements, and wherein the spring elements are configured such that, after the drying or curing is completed, a force exerted on the at least one winding is dimensioned to be higher than an expanding electromagnetic force of the winding in case of a short circuit condition of the transformer.

20. The method of claim 18, wherein a shrinkage of the windings during drying or curing is compensated by the pistons.

* * * * *